US006102653A

United States Patent [19]

Marx

[11] Patent Number: 6,102,653

[45] Date of Patent: Aug. 15, 2000

[54] FEED PUMP

[75] Inventor: Peter Marx, Kassel, Germany

[73] Assignee: Mannesmann VDO AG, Germany

[21] Appl. No.: 09/186,864

[22] Filed: Nov. 5, 1998

[30] Foreign Application Priority Data

Nov. 7, 1997 [DE] Germany ..... 197 49 404

[51] Int. Cl.[7] ..... F04D 5/00

[52] U.S. Cl. ..... 415/55.1; 415/55.2

[58] Field of Search ..... 415/55.1, 55.2, 415/55.3, 55.4, 55.5, 55.6, 55.7

[56] References Cited

U.S. PATENT DOCUMENTS 5,310,308 5/1994 Yu et al. ..... 415/55.2

5,328,325 7/1994 Strohl et al. ..... 415/55.1

FOREIGN PATENT DOCUMENTS

4423314A1 1/1996 Germany .

19615322A1 10/1997 Germany .

60-173389 9/1985 Japan ..... 415/55.1

*Primary Examiner*—Edward K. Look

*Assistant Examiner*—Richard Woo

*Attorney, Agent, or Firm*—Mayer, Brown & Platt

[57] ABSTRACT

In a feed pump (2) designed as a side channel pump, with an impeller (5) rotating in a pump casing (3) and having blade chambers (12, 13), the blade chambers (12 13) have an inflow region (16, 17), the profile of which is designed asymmetrically to that of an outflow region (18, 19). The feed pump (2) can thereby be adapted to an intended characteristic simply by exchanging or reversing the rotation of the impeller (5).

13 Claims, 2 Drawing Sheets

FEED PUMP

BACKGROUND OF THE INVENTION

The invention relates to a feed pump with a driven impeller which rotates in a pump casing and has, in each case, in its end faces a ring of guide blades delimiting blade chambers and in which the blade chambers have an inflow region and an outflow region for the medium to be fed, and with partially annular ducts which are arranged in the pump casing on both sides in the region of the guide blades and which, with the blade chambers, form feed chambers, an inlet duct opening into one feed chamber and the other feed chamber opening into an outlet duct, and the feed chambers being connected to one another in the region of the blade chambers.

Such feed pumps are often used for feeding fuel in a fuel tank of an automobile and are therefore known. When the impeller rotates, the guide blades transmit an angular momentum to the medium to be fed and generate in the feed chambers a circulation flow which runs transversely to the direction of movement of the guide blades. This circulation flow enters the impeller in the inflow regions of the blade chambers and leaves the impeller in the outflow regions of the blade chambers. The circulation flows run in opposition and are continued in the partially annular ducts. Since the feed chambers are connected at the blade chambers which are located opposite one another, the fed liquid passes from the inlet-side feed chamber into the outlet-side feed chamber. The feed chambers of the known feed pumps have, in each case, at least approximately circular cross sections. In a feed pump intended for generating a high feed pressure, the feed chambers are, as a rule, arranged on a particularly large radius. In order to generate a high feed volume, it is necessary, as a rule, for the feed chambers of the feed pump to have large cross sections.

A disadvantage of the known feed pump is that a feed pump having a different characteristic is required, in each case, for different media to be fed and for different intended feed volumes and feed pressures. If the feed pump is to be used as a fuel pump in an automobile, it is necessary, for example for diesel and gasoline engines and for different engine powers, to have feed pumps which are designed specifically for these purposes.

The problem on which the invention is based is to design a feed pump of the initially mentioned type, in such a way that it can be adapted to different characteristics with the least possible outlay.

This problem is solved, according to the invention, in that the profiles of mutually opposite blade chambers and/or of the inflow regions and of the outflow regions are designed asymmetrically to one another, in the case of at least some of the blade chambers, in order to generate an intended feed pump characteristic.

By virtue of the profile of the blade chambers, the transmission of angular momentum, taking place in the impeller, to the medium to be fed can be influenced in a particularly simple way. Owing to the invention, it is possible, by means of the feed pump, to generate different characteristics simply by exchanging or reversing the rotation of the impeller and, consequently, to adapt the feed pump to the respective areas of use and the media to be fed.

According to an advantageous development of the invention, the blade chambers can be provided with different profiles in a simple way, if the profiles of the inflow regions and of the outflow regions are formed, in each case, by a radius, and if the radii of the inflow regions and of the outflow regions differ from one another in length and/or in origin. In this case, the size of the individual radii and the arrangement of the origins of the radii depend on the intended characteristic and therefore on the size of the feed pump and on the material values of the medium to be fed. In order to avoid flow losses, the profile of the blade chambers can be smoothed in a transitional region between the inflow region and the outflow region.

For the overflow of the medium to be fed, a higher pressure must prevail in the inlet-side feed chamber than in the outlet-side feed chamber. According to another advantageous development of the invention, in the inlet-side feed chamber a particularly high angular momentum is transmitted to the medium to be fed, if the blade chambers of the inlet-side feed chamber have a smaller radius at their inflow regions than at their outflow regions. By virtue of this design, the flow transition from the inlet-side feed chamber to the outlet-side feed chamber is improved, as compared with the known feed pump. The feed pump thereby has particularly high efficiency.

According to another advantageous development of the invention, it is conducive to further improvement in the flow transition from the inlet-side feed chamber to the outlet-side feed chamber if the blade chambers of the outlet-side feed chamber have a smaller radius at their inflow regions than at their outflow regions.

According to another advantageous development of the invention, the medium to be fed overflows from the inlet-side feed chamber into the outlet-side feed chamber with particularly low loss if the origins of the radii of the blade chambers of the inlet-side feed chamber are arranged further inward in the axial direction of the impeller than the origins of the radii of the blade chambers of the outlet-side feed chamber.

Often, in order to feed fuel, a feed pump is used, in which the connection of mutually opposite blade chambers is arranged between the inflow regions and the outflow regions of the blade chambers. Such feed pumps are, as a rule, designated as side channel pumps. In this case, the intended characteristics can be generated in a simple way by leading the inflow region or the outflow region of one of the blade chambers into a blade chamber located axially opposite this blade chamber. In this case, the inflow regions or the outflow regions of the blade chambers form part of the profile of the blade chambers located axially opposite these blade chambers. This may be carried out either by means of radii of different size or by means of a different arrangement of the origins of the radii.

The feed pump according to the invention has a particularly high zero feed pressure if the inflow region of the blade chamber of the inlet-side feed chamber is led into the blade chamber of the outlet-side feed chamber. In this case, a part stream is deflected from the circulation flow in the inlet-side feed chamber into the outlet-side feed chamber by means of the profiles of the blade chambers. This results in a particularly low-loss transition of the flow from the inlet-side feed chamber into the outlet-side feed chamber.

According to another advantageous development of the invention, it is conducive to a further increase in the zero feed pressure if the outflow region of the blade chamber of the outlet-side feed chamber is led into the blade chamber of the inlet-side feed chamber.

According to another advantageous development of the invention, in the case of average delivery coefficients of more than 0.4, high values for the pressure coefficient can be achieved if the inflow region of the blade chamber of the outlet-side feed chamber is led into the blade chamber of the inlet-side feed chamber.

According to another advantageous development of the invention, it is conducive to a further increase in the pressure coefficient in the case of average delivery coefficients if the outflow region of the blade chamber of the inlet-side feed chamber is led into the blade chamber of the outlet-side feed chamber.

Tests have shown that, in the case of gasoline fuel as the medium to be fed, the feed pump according to the invention has particularly high efficiency if the end of the outflow region led into the respectively opposite blade chamber is at an axial distance $a=\gamma\frac{1}{2}(ra-ri)\,ra/ri$ from the end of the inflow region, ra designating the outer radius and ri the inner radius of the ring of guide blades and $\gamma$ being in the range of between 0.02 and 0.16.

It is conducive to further improvement in the efficiency of the feed pump according to the invention if the guide blades ascend from the middle region of the impeller toward the end faces, as seen in the direction of rotation of the impeller.

BRIEF DESCRIPTION OF THE DRAWINGS

The invention permits numerous embodiments. In order to make its basic principle even clearer, two of these are illustrated in the drawing and are described below. In the drawing.

DETAILED DESCRIPTION OF THE PREFERRED EMBODIMENTS

Figure 1:
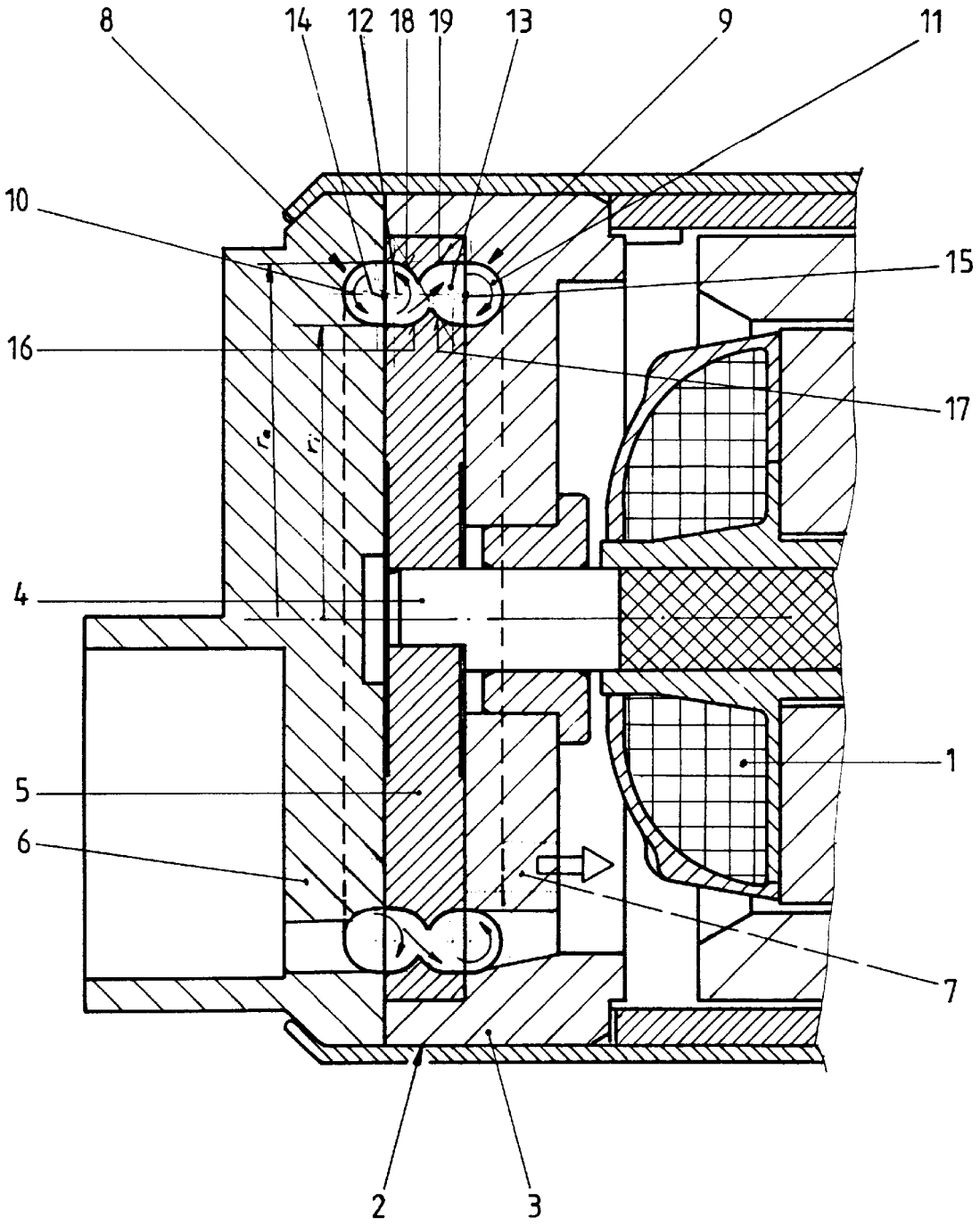
FIG. 1 shows a sectional illustration through a feed pump according to the invention.

FIG. 1 shows a longitudinal section through a feed pump 2 according to the invention which is driven by an electric motor 1 and is designed as a side channel pump and which may be intended, for example, for feeding fuel out of a fuel tank, not illustrated, of an automobile. The feed pump 2 has a pump casing 3, in which an impeller 5 fastened fixedly in terms of rotation on a shaft 4 of the electric motor 1 is arranged. The pump casing 3 has an inlet duct 6 on its side facing away from the electric motor 1 and an outlet duct 7 on the side facing the electric motor 1. The fed medium thereby flows through the feed pump 2 axially. The inlet duct 6 opens into a feed chamber 8. A second feed chamber 9 opens into the outlet duct 7. The feed chambers 8, 9 have, in each case, partially annular ducts 10, 11, incorporated in the pump casing 3, and blade chambers 12, 13 arranged in the impeller 5. The blade chambers 12, 13 are delimited, in each case, by guide blades 14, 15 and, in each case, have an inflow region 16, 17 for the inflow of the medium to be fed and an outflow region 18, 19. Mutually opposite blade chambers 12, 13 are connected to one another between the inflow region 16, 17 and the outflow region 18, 19.

When the impeller 5 rotates, circulation flows occur in the feed chambers 8, 9. A part stream is branched off from the circulation flow of the inlet-side feed chamber 8 and overflows into the outlet-side feed chamber 9. The flows are marked by arrows in the drawing. The inflow region 16 of the blade chamber 12 of the inlet-side feed chamber 8 is led into the blade chamber 13 of the outlet-side feed chamber 9. Furthermore, the outflow region 19 of the blade chamber 13 of the outlet-side feed chamber 9 is led into the blade chamber 12 of the inlet-side feed chamber 8. The part stream of the circulation flow is thereby deflected from the inlet-side feed chamber 8 into the outlet-side feed chamber 9. As a result, the feed pump 2 has a particularly high zero feed pressure. If the impeller 5 is fastened on the shaft 4 so as to have reversed rotation, the feed pump 2 achieves high pressure values in the case of average delivery coefficients. As a result, in the case of straight blades, the characteristics of the feed pump 2 according to the invention can be modified in a simple way by means of the installation position of the impeller 5.

Figure 2:
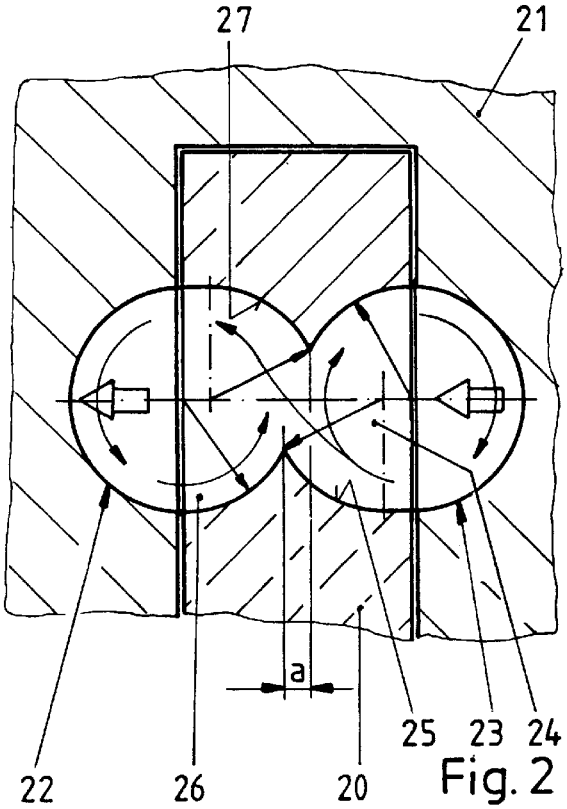
FIGS. 2–5 show sectional illustrations through various embodiments of the feed pump according to the invention in the region of feed ducts.

FIG. 2 shows, in a part section, a further embodiment of the feed pump according to the invention in a radially outer region of an impeller 20 rotating in a pump casing 21 and having feed chambers 22, 23. This feed pump is designed as a side channel pump in the same way as the feed pump 2 of FIG. 1. A blade chamber 24 of the right feed chamber 23 has an inflow region 25 which is formed by a radius and which is led into a blade chamber 26 of the left feed chamber 22. An outflow region 27 of the blade chamber 26 of the left feed chamber 22 is led into the right blade chamber 24. The profiles of the inflow regions 25 and the outflow regions 27 of the blade chambers 24, 26 are formed by radii. It can be seen clearly that the end of the outflow region 27 of the left blade chamber 26 is at an axial distance a from the end of the inflow region 25 of the right blade chamber 24. In the drawing, the flows within the feed chambers 22, 23, in the case of a connection of the right feed chamber to an inlet duct, are marked by arrows. In this case, the part stream is branched off from the right feed chamber 23 into the left feed chamber 22.

Figure 3:
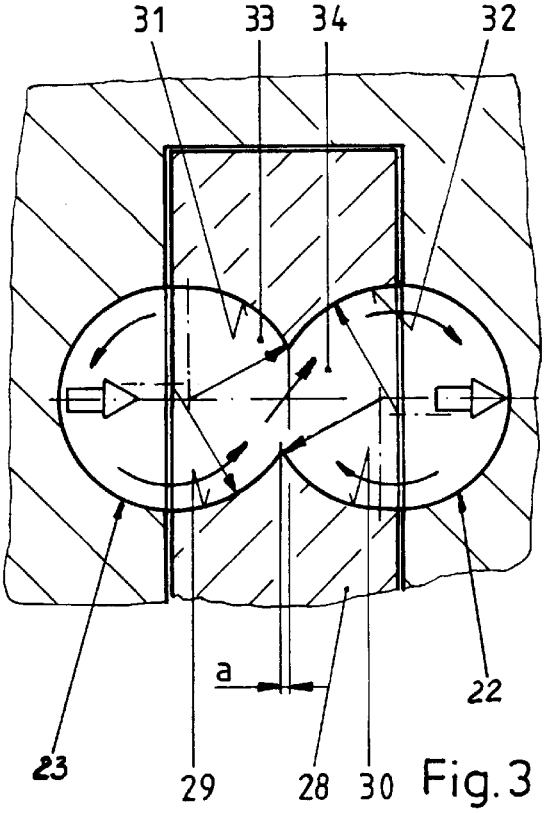

FIG. 3 shows, in a part section through the radially outer region of an impeller 28, a further embodiment of the feed pump according to the invention, in which the radii of the profile of inflow regions 29, 30 and outflow regions 31, 32 of blade chambers 33, 34 have a different size and their origins are arranged so as to be offset to one another. As a result, the inflow region 30 of the right blade chamber 34 and the outflow region 31 of the left blade chamber 33 project into the other blade chamber 33, 34 respectively. If the left blade chamber 33 is connected to an inlet duct, the feed pump has particularly high values for the pressure coefficient in the case of average delivery coefficients.

Figure 4:
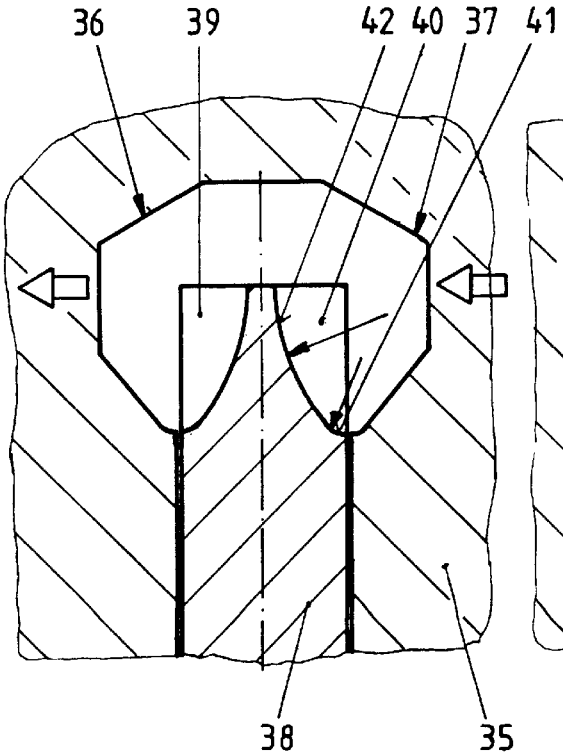

FIG. 4 shows a sectional illustration through the radially outer region of a feed pump designed as a peripheral pump, with a pump casing 35 and two feed chambers 36, 37. The feed chambers 36, 37, in this case, surround the radially outer region of an impeller 38, in which blade chambers 39, 40 are arranged on both sides. In this case, an inflow region 41 and an outflow region 42 of the right blade chamber 40 have, in each case, profiles formed by radii. The radius of the inflow region 41 is, in this case, smaller than the radius of the outflow region 42. If the flow passes through the feed pump from right to left, in the right blade chamber 40 a particularly high angular momentum can, be transmitted to the medium to be fed. As a result, the feed pump has particularly high efficiency.

Figure 5:
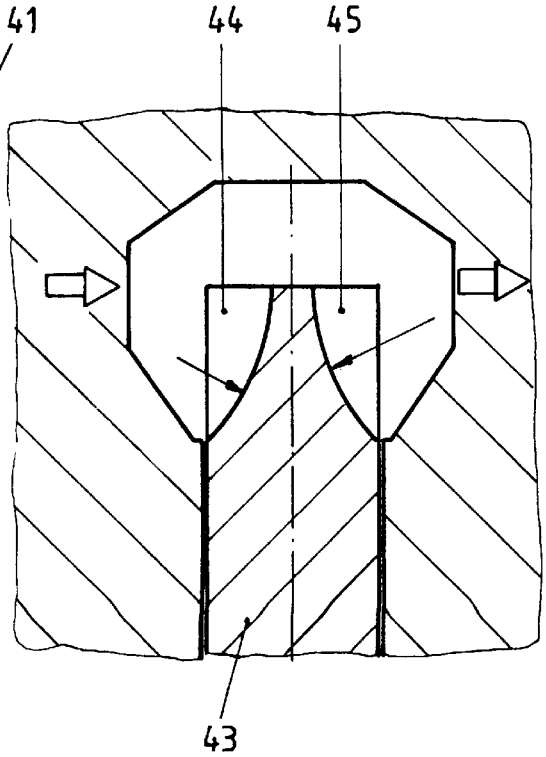

In an embodiment of the feed pump according to the invention, illustrated in FIG. 5, two blade chambers 44, 45 arranged opposite one another in an impeller 43 have, in each case, profiles formed by radii of different size. In this case, the radius of the left blade chamber 44 is smaller than the radius of the right blade chamber 45. As in the feed pump illustrated in FIG. 4, this results in a particularly high transmission of angular momentum in the left blade chamber 44.

What is claimed is:

1. A feed pump with a driven impeller which rotates in a pump casing and has, in each case, in its end faces a ring of guide blades delimiting blade chambers and in which the blade chambers have an inflow region and an outflow region for the medium to be fed, and with partially annular ducts which are arranged in the pump casing on both sides in the region of the guide blades and which, with the blade chambers, form inlet-side and outlet-side feed chambers, an inlet duct opening into the inlet-side feed chamber and the outlet-side feed chamber opening into an outlet duct, and the feed chambers being connected to one another in the region of the blade chambers, wherein the profiles of mutually opposite blade chambers are asymmetric to one another, in the case of at least some of the blade chambers.

2. The feed pump as claimed in claim 1, in which the connection of mutually opposite blade chambers is arranged between the inflow regions and the outflow regions of the blade chambers, wherein the inflow region and the outflow region of one of the blade chambers is led into the outflow region and inflow region, respectively, of the same blade chamber.

3. The feed pump as claimed in claim 2, wherein the inflow region of the blade chamber (24) of the inlet-side feed chamber is led into the blade chamber of the outlet-side feed chamber.

4. The feed pump as claimed in claim 2, wherein the outflow region of the blade chamber of the outlet-side feed chamber is led into the blade chamber of the inlet-side feed chamber.

5. The feed pump as claimed in claim 2, wherein the inflow region (30) of the blade chamber (34) of the outlet-side feed chamber (22) is led into the blade chamber (33) of the inlet-side feed chamber (23).

6. The feed pump as claimed in claim 2, wherein the outflow region of the blade chamber of the inlet-side feed chamber is led into the blade chamber of the outlet-side feed chamber.

7. The feed pump as claimed in claim 2, wherein the end of the outflow region led into the respectively opposite blade chamber is at an axial distance $a=\gamma^{1/2}$ (ra−ri) ra/ri from the end of the inflow region ra designating the outer radius and ri the inner radius of the ring of guide blades and $\gamma$ being in the range of between 0.02 and 0.16.

8. The feed pump as claimed in claim 1, wherein the guide blades ascend from the middle region of the impeller toward the end faces, as seen in the direction of rotation of the impeller.

9. A feed pump with a driven impeller which rotates in a pump casing and has, in each case, in its end faces a ring of guide blades delimiting blade chambers and in which the blade chambers have an inflow region and an outflow region for the medium to be fed, and with partially annular ducts which are arranged in the pump casing on both sides in the region of the guide blades and which, with the blade chambers, form inlet-side and outlet-side feed chambers, an inlet duct opening into the inlet-side feed chamber and the outlet-side feed chamber opening into an outlet duct, and the feed chambers being connected to one another in the region of the blade chambers, wherein the profiles of the inflow regions and of the outflow regions are formed, in each case, by a radius, and wherein the radii of the inflow regions and of the outflow regions differ from one another in length or in origin.

10. The feed pump as claimed in claim 9, wherein the blade chambers of the inlet-side feed chamber have a smaller radius at the inflow regions than at the outflow regions.

11. The feed pump as claimed in claim 9, wherein the blade chambers of the outlet-side feed chamber have a smaller radius at the inflow regions than at the outflow regions.

12. The feed pump as claimed in claim 9, wherein the origins of the radii of the inflow regions are arranged further inward in the axial direction of the impeller than the origins of the radii of the outflow regions.

13. The feed pump as claimed in claim 9, wherein the guide blades ascend from the middle region of the impeller toward the end faces, as seen in the direction of rotation of the impeller.

* * * * *